US007183919B2

(12) United States Patent
Wang

(10) Patent No.: US 7,183,919 B2
(45) Date of Patent: Feb. 27, 2007

(54) RFID DELIVERY AND PICKUP DETERMINATION SYSTEM

(76) Inventor: Shih-Ho Wang, 1613 Holly La., Davis, CA (US) 95616-1010

( * ) Notice: Subject to any disclaimer, the term of this patent is extended or adjusted under 35 U.S.C. 154(b) by 78 days.

(21) Appl. No.: 10/904,362

(22) Filed: Nov. 5, 2004

(65) Prior Publication Data

US 2005/0068181 A1 Mar. 31, 2005

(51) Int. Cl.
*G08B 13/14* (2006.01)

(52) U.S. Cl. ..... 340/572.1; 340/569

(58) Field of Classification Search ..... 340/569
See application file for complete search history.

(56) References Cited

U.S. PATENT DOCUMENTS 6,104,311 A * 8/2000 Lastinger ..... 340/10.51
6,275,154 B1 * 8/2001 Bennett et al. ..... 340/569
6,462,659 B1 * 10/2002 Schuette ..... 340/569
6,483,433 B2 11/2002 Moskowitz et al. ..... 340/568.1
6,745,027 B2 * 6/2004 Twitchell, Jr. ..... 455/422.1
6,816,074 B2 * 11/2004 Wong ..... 340/569
6,904,000 B1 6/2005 Lee ..... 367/128
6,967,575 B1 * 11/2005 Dohrmann et al. ..... 340/568.1
6,967,577 B2 * 11/2005 Taylor et al. ..... 340/572.1
2003/0057270 A1 3/2003 Collen ..... 235/375
2003/0105729 A1 * 6/2003 Waxler ..... 705/404
2004/0030722 A1 2/2004 Garey ..... 707/104.1
2004/0074957 A1 4/2004 Devar ..... 232/17
2005/0060246 A1 * 3/2005 Lastinger et al. ..... 705/28
2005/0216119 A1 * 9/2005 Hamilton ..... 700/224

* cited by examiner

*Primary Examiner*—Daniel Wu
*Assistant Examiner*—Eric M. Blount
(74) *Attorney, Agent, or Firm*—Raymond E. Roberts; Intellectual Property Law Offices

(57) ABSTRACT

A deliver and pickup determination system (DDS)(10) for determining whether an object (18) has been delivered at or picked up from a collection-unit (14) such as a mailbox, postbox drop-box, cubby-hole, etc. A radio-frequency identification (RFID) tag (24) is placed in fixed conjunction with each collection-unit of interest, wherein there typically can be tens or hundreds comprising one or more collection-stations (12). A detection and recording device (DRD)(26) worn about the hand of the clerk then senses and collects information about each RFID tag when brought into proximity with it as the object is handled at the collection-unit.

27 Claims, 4 Drawing Sheets

RFID DELIVERY AND PICKUP DETERMINATION SYSTEM

TECHNICAL FIELD

The present invention relates generally to electrical communications for handling information or intelligence related to the delivery or pickup of an object, and more particularly to a condition responsive indicating system where an electrical means provides a humanly perceptible signal in response to the attainment of a predetermined condition with respect to the object.

BACKGROUND ART

Our society is one where we and many objects that we value are very mobile. Of particular present interest, at one time or another a large proportion of such objects will be picked up, shipped, and delivered from one location to another. The ubiquitous example of a system for this in the United States is the postal mail and parcel post system provided by the U.S. Postal Service, wherein objects are delivered to us at a mailbox or postbox and in many places we can also leave objects at our personal mailboxes for pickup to be sent to others.

Almost as common today are private parcel delivery services, which operate similarly in many respects. Most of these started out delivering and picking up objects at our homes and workplaces, and today many have grown into operations that resemble a full postal system in end result. Notably, many of these services today provide tens, hundreds, or even thousands of postboxes to their clients. There are various reasons these have appeal, including efficiency, cost, privacy, and reliability, to state only a few. Some current examples of such services are United Parcel Service, with its UPS STORES, and Federal Express, with its FedEx DEPOTS.

In our workplaces we see all of these systems used, and often one or more organizational delivery and pickup systems as well. Many of us use these regularly and rely upon them for our own and our organization's economic well being.

The nature of the objects delivered and picked up in all of these systems can vary considerably. For example, an object can be as small as a business card, as common as a letter, as fragile and perishable as a bouquet of flowers, or as large and as expensive as a 60 inch (1.5 meter) plasma-screen television.

The nature of the places where these objects are delivered and picked up can also vary considerably. The place may be open, enclosed on most sides, or completely enclosable. On a company loading dock or in its shipping room as little as a sign reading "Deliveries" may demarcate a space on the floor or an open desktop where deliveries are to be left and pickups to be taken from. In contrast, the common hotel lobby drop box and office "mailbox" are usually open on one or two sides. Alternately, typical postal mailboxes today are completely enclosable, having a door that must be opened to put an object inside and the same or another door then opened to remove the object.

Another aspect of the places where objects are delivered and picked up is their remoteness from us when delivery or pickup actually occurs. For instance, for most of us that work outside the home, objects delivered to our homes arrive while we are away. In many rural areas and in most urban apartment or condo complexes today, the places where objects are delivered often is some distance away from our personal living space, say, on the first floor, at the end of the lane, or even away in the nearest town. In our work places, we rarely are in the mailroom when objects arrive for us, and in our mobile world we may already be half way around the world by the time an object that we left in the mailroom is picked up.

The natures of the parties involved in all of this are somewhat easier to characterize. A delivery person or clerk deliverers an object to a previously designated place for us to retrieve, and we can often leave an object in such a place for such a clerk or delivery person to pickup.

Unfortunately, these delivery and pickup systems often have a common limitation—they generally include no way to advise us that a delivery or pickup has occurred. Sometimes this is not important, but other times it can be critically important to us to know this and details about it. For example, if we are waiting for important documents that require our signature and prompt return, we do not want to have to wait in or repeatedly visit our company mailroom, hotel lobby, or apartment building foyer until the documents arrive. Keeping even the fact of the delivery or pickup private or secure can also be an important concern. After all, we may not want flowers delivered to us setting out for hours where our neighbors or coworkers can see then and start idle speculation or even walk over and read a return address. And we probably do not want our newly delivered 60 inch television to sit out in the rain until we come home, or to sit unattended long enough that it might be stolen.

Of course, various solutions to this delivery and pickup status problem exist. If we live in an apartment building our mail-person may customarily press the entryway door-buzzer for each tenant who's mailbox they deliver mail to. Or we can inform a mailroom clerk in our company that we are expecting important documents and ask them to call us when those arrive. But such ad-hoc human solutions tend to have their own set of problems. Few mail-people today buzz tenants about mail deliveries, because they know that people often are not home to hear the buzzer or that those who are may work nights and resent such. Or our company's mail-room clerk may not tell their lunch time substitute how to deal with our important documents.

In response to the failings of such systems, more formal and sophisticated ones have been developed. For example, Mail Boxes Etc. now offers a service with the self-descriptive name "CALL-IN MAILCHECK™ SERVICE." Some organizations have even tried having their object delivery and pickup places individually "hard wired" with buttons to push to activate an alarm in the event of a delivery or pickup. Alternately, a company can institute a policy that its mail-room clerks should always send an e-mail notification to an employee when a delivery is received. However, these approaches still have limitations and disadvantages. For instance, they are unduly susceptible to human failure and their reliance on additional human activity often makes them too expensive.

Considerations like this have resulted in still more sophisticated solutions being devised that attempt to entirely remove any "human factor." One such solution that has been proposed, albeit one that we do not know to have actually been put into practical use, is to mount video-surveillance cameras where they can view mailboxes and to then use computerized image processing and pre-stored repository position information to determine which mailboxes are being or have been accessed. Variations on this even encompasses having the holder of a mailbox be notified by an automated e-mail or v-mail.

Unfortunately, while such an approach is highly laudable for creativity and providing an excellent set of user-notification features, it still lacks in practicality by being expensive and error prone. For example, if the act of a clerk accessing a mailbox is that used as determinative, multiple cameras may need to be used or the clerk may have to adopt consistent movement patterns. Alternately, if the presence of an object in a mailbox is what is used as determinative, multiple cameras may still be needed, to catch smaller or flat objects, and the color, texture, etc. of the objects may still cause them to be overlooked.

Accordingly, what is needed is an improved delivery and pickup determination system. Such a system should preferably be both highly automated and economical; should preferably require minimal, if any, interaction with or changes from conventional practice by the clerks engaged in handling deliveries and pickups; and should preferably work with the same wide variety of types of objects that existing systems customarily handle.

DISCLOSURE OF INVENTION

Accordingly, it is an object of the invention as claimed herein to provide a radio-frequency identification (RFID) tag based delivery and pickup determination system.

Briefly, one preferred embodiment of the present invention is a system for determining whether a clerk has delivered or picked up an object at a particular collection-unit in a collection-station, where the particular collection-unit is assigned to an owner of the object. A radio-frequency identification (RFID) tag is placed in fixed conjunction with the particular collection-unit. A detection and recording device (DRD) worn about the hand of the clerk then can sense and collect information about the RFID tag when brought into proximity with it as the object is handled at the particular collection-unit.

The objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE DRAWINGS

The purposes and advantages of the present invention will be apparent from the following detailed description in conjunction with the appended figures of drawings in which.

In the various figures of the drawings, like references are used to denote like or similar elements or steps.

BEST MODE FOR CARRYING OUT THE INVENTION

Figure 1:
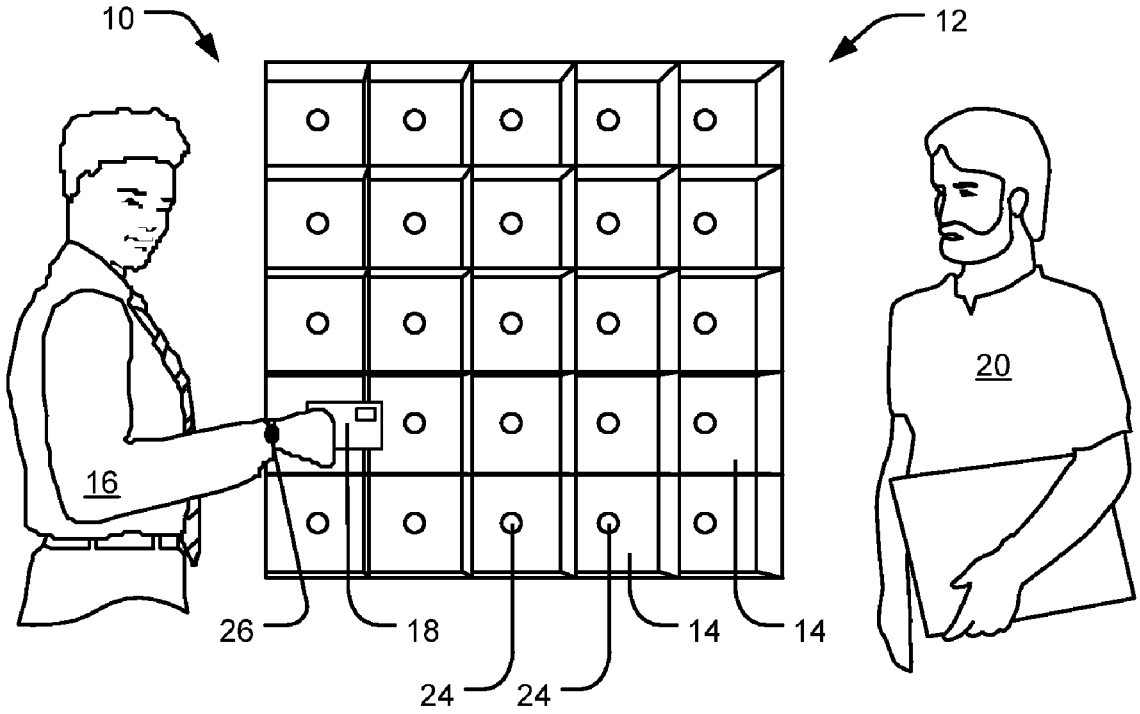
FIG. 1 is a schematic diagram providing an overview of how a delivery and pickup determination system (DDS) in accord with the present invention may be employed.

A preferred embodiment of the present invention is a delivery and pickup determination system. As illustrated in the various drawings herein, and particularly in the view of FIG. 1, preferred embodiments of the invention are depicted by the general reference character 10.

This invention provides a simple and effective system and method to detect, and optionally record, the time of a delivery, pickup, or other activity with respect to one or more mailboxes, drop-boxes, cubby-holes, etc. (hereinafter, "collection-stations"). Additionally, this invention provides a simple and effective system and method to notify users of such collection-stations about such activities.

FIG. 1 is a schematic diagram providing an overview of how a delivery and pickup determination system (DDS 10) in accord with the present invention may be employed. The DDS 10 is used with a collection-station 12 that is generally conventional. The collection-station 12 may include as few as one collection-unit 14 or many collection-units 14, with tens or hundreds expected to be typical in many embodiments of the DDS 10.

Two classes of parties will usually work with the collection-station 12. One or more clerks 16 can deposit or pick-up objects 18 in the individual collection-units 14, and clients 20 that "own" the collection-units 14 (i.e., rent, have been assigned them, etc.) can pick-up or leave objects 18 in their respective collection-units 14.

As already described, the present problem is how does a particular client 20 know that some action has been taken with respect to their collection-unit 14 or collection-units 14? For example, a client 20 may want to know if a clerk 16 has placed any objects 18 into their specific collection-unit 14, or if the clerk 16 has retrieved one or more objects 18 that the client 20 has previously left in a collection-unit 14 for pickup.

The inventive DDS 10 solves this problem based on the strong presumption that an action of some importance has occurred whenever a clerk 16 accesses a specific collection-unit 14. Briefly, the DDS 10 solves the problem by adding one or more tags 24 to the collection-units 14 that are of interest, and then having the respective tags 24 sensed with a detection and recording device (DRD 26) in the course of the clerks 16 accessing the collection-units 14.

Figure 2:
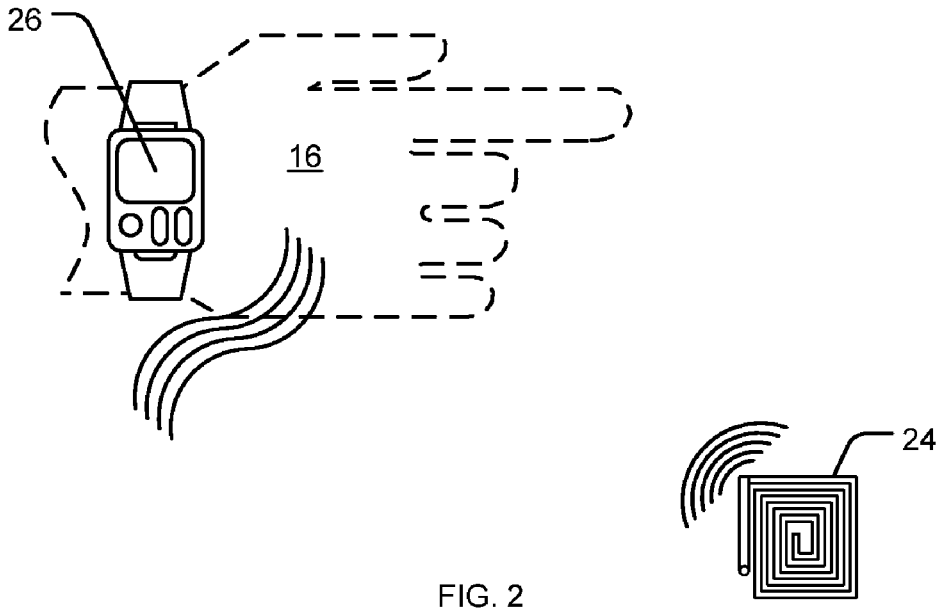
FIG. 2 is a schematic diagram depicting the working relationship of a radio-frequency identification (RFID) tag and a detection and recording device (DRD) in accord with the present invention.

Continuing now also with FIG. 2, which schematically depicts the working relationship of a tag 24 and a DRD 26, the tags 24 are preferably radio-frequency identification (RFID) type devices, with either passive or active type units being suitable. RFID is a method of identification which utilizes a signal transmitted between an electronic device, termed the "tag" or "RFID transponder," and a reading device, termed a "transceiver" or "RFID interrogator." In the DDS 10 the tags 24 perform the role of RFID transponder and the DRD 26 performs the role of RFID interrogator.

The tags 24 may be entirely conventional, and many excellent candidates are available in the components market today. Each tag 24 can have a unique identification characteristic but this is not an absolute requirement. For instance, ten different collection-units 14 that are used by one client 20 might all have tags 24 with the same identification characteristic. However, since it will usually be a simpler matter to "program" the DDS 10 so that different unique tags 24 are associated with the same client 20, it is anticipated that the use of non-unique tags will be rare.

The tags 24 can be physically affixed in conjunction with their respective collection-units 14 or they can be temporarily fixed with respect to their collection-units 14. For example, a tag 24 can be glued, riveted, nailed or screwed "down," etc. to semi-permanently fix it into position relative to the collection-units 14. In particular, since the tags 24 can be made quite small, inexpensive, and easily adopted to this form factor, they can be in stickers, for instance, ones of conventional postage stamp-size, that are stuck on a wall of the collection-station 12. Alternately, the tags 24 can be placed stationary (temporarily "fixed" in position) with their respective collection-units 14. For instance, they can be made in a "poker-chip" or "hockey-puck" size form factor permitting them to be placed in their collection-units 14 or elsewhere about the collection-station 12 so that they are in conjunction with their respective collection-units 14 when a DRD 26 is brought near (e.g., when an object 18 is being delivered or picked up). This latter approach is especially useful if the collection-units 14 are often reconfigured or reassigned. Thus, for example, if John Doe has been assigned Box 2 but now needs to be assigned Box 9 because he needs a box able to hold more (see e.g., FIG. 6), a poker-chip sized tag 24 (say, one marked "John Doe-1.202.555.1234" with external indicia) can simply be taken out of Box 2 and tossed into Box 9. If there are concerns that the tag 24 here needs to be more robustly fixed, it can be stuck in place with a hook-and loop fastener (e.g., VELCRO) or can magnetically attach to an appropriate surface for this.

The DRD 26 used in the DDS 10 is preferably "worn" by a clerk 16 on or about their hand, much like a common wrist-watch or bracelet is worn. This allows the DRD 26 here to sense a tag 24 as the clerk 16 puts their hand into close proximity with that tag 24. In particular, since the clerk 16 will usually only be putting their hand into a collection-unit 14 to deposit or to pickup an object 18 there in, the DRD 26 is able to read the identification characteristic of the tag 24 or tags 24 that it comes into proximity with and to communicate information about this onward.

Figure 3:
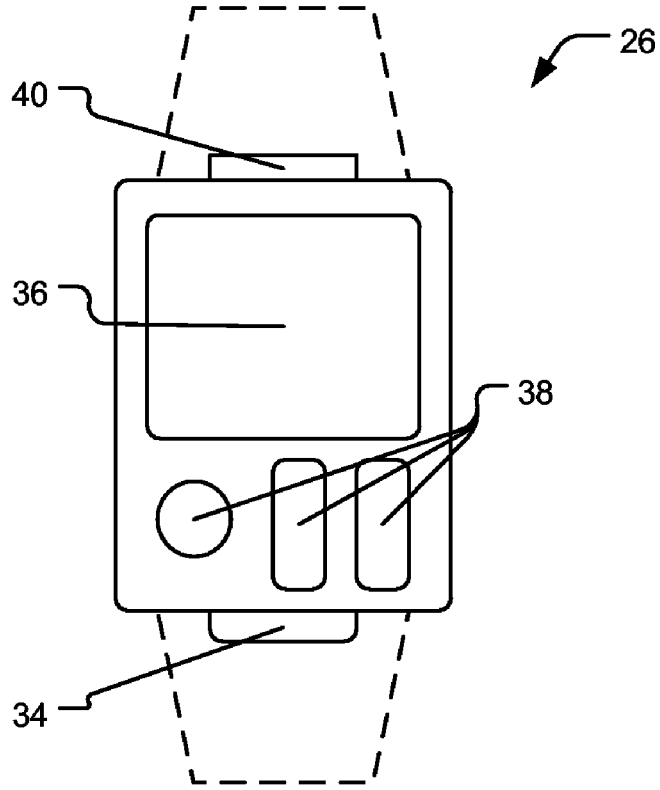
FIG. 3 is a stylized plan view depicting an exemplary DRD such as that in FIGS. 1 and 2.
Figure 4:
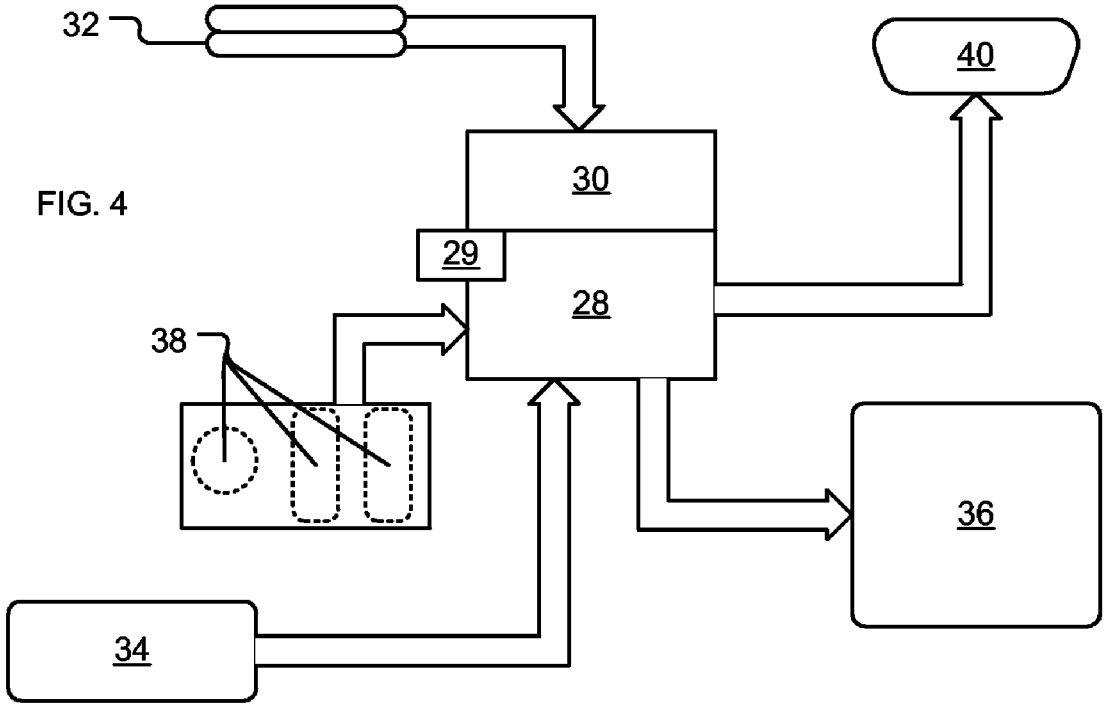
FIG. 4 is a block diagram depicting the major components and their general working relationships of the exemplary DRD in FIG. 3.

FIG. 3 is a stylized plan view and FIG. 4 is a block diagram depicting an exemplary DRD 26. The DRD 26 here includes a processor 28, a real time clock 29, a memory 30, a power source 32, a sensor 34, a display 36, a set of control buttons 38, and an input-output port (I/O port 40).

The processor 28 is used in straightforward manner, to control the rest of the components. The real time clock 29 is optional, but is useful for time-stamping events in many embodiments of the DRD 26. The memory 30 stores an instruction set to run the processor 28 and, optionally, can store a number of identification characteristics accumulated from the tags 24.

The power source 32 can be any of many generally conventional devices. For example, without limitation, it can include a disposable or a rechargeable battery. A rechargeable battery or capacitor can be used and charged conductively by putting the DRD 26 into a charging station powered, in turn, from an AC "wall" or "lines" source. The DRD 26 can "leach" power via its I/O port 40 when it is physically connected to an external system, much in the way many devices do this via a Universal Serial Port (USB). Since the DRD 26 is used or often returns to one or a few specific locations (e.g., collection-units 14), it can be inductively charged with power supplied from an external electromagnetic field at one or more such locations. The power source 32 can even be human-powered, charging a battery or capacitor by generating power from the physical movements of the clerk 16 using the DRD 26.

The choice for the power source 32 will largely be straightforward based on the design considerations for a particular embodiment of the DRD 26, with some typical factors being the capacity of the power source 32 with respect to whether the tags 24 are of a passive or active type and how long the DRD 26 may need to be used between replenishing the power source 32.

The sensor 34 is matched in type to the tags 24 that are used, particularly with respect to whether they are of a passive or an active type and especially with respect to the range at which a tag 24 is desirably sensed. The DDS 10 can be embodied according to a policy where an individual collection-unit 14 should only ever contain a single tag 24. If more than one tag 24 is then ever sensed concurrently, the circuitry of the sensor 34 can discriminate based on the strongest signal. Alternately, the DDS 10 can be embodied so that a single collection-unit 14 may include more than one tag 24. The sensor 34 can then intentionally have a low sensitivity, so that a false indication from a tag 24 in an adjacent collection-unit 14 is difficult. Alternately, or additionally, the collection-stations 12 can be of a material that strongly suppresses signal propagation, and thus minimize false indications.

The display 36 is optional, but will be desirable in many embodiments of the DRD 26 for various reasons, and the capabilities and the sophistication that the display 36 then adds to the DRD 26 can vary considerably. In FIG. 3 the display 36 shown is a small screen, such as a low-power liquid crystal type unit. A screen permits complex information like box numbers for the collection-units 14, signal strengths for tag-sensor couplings, estimated remaining power capacity, etc. to be displayed. The display 36 does not need to be a screen, however. For example, it can simply be one or more light emitting diodes (LEDs). The salient piece of information that the clerk 16 needs is whether the DRD 26 has been triggered by proximity to a tag 24, and a single green LED that is latched on for two seconds is more than adequate for this. A multi-color LED or a flashing LED scheme can also be used, say, to further convey low remaining power or storage capacity. The display 36 need not even convey the information it provides visually. Instead, or additionally, it can use sound or vibration. Accordingly, the choice for the display 36 is largely a straightforward matter of design preference.

The control buttons 38 are also optional. Without limitation, some cases where one or more of them are provided and used include the following. A control button 38 can be used to put the DRD 26 into a low- or no-power mode. For instance, if the tags 24 are a passive type, the sensor 34 will need to be an active type and will therefore consume appreciable energy. It then may be desirable to power down at least the sensor 34 when the DRD 26 is not in formal use. Also, if the memory 30 is all or at least partially a dynamic type, or if keeping some functions always active is desired, the DRD 26 can be configured to permit powering down only some components. Of course, if the memory 30 is all or at least partially a static type, an on-off control button 38 can be provided to completely power down and power up the DRD 26. One or more of the control buttons 38 can be used to control the display 36. Another use is for a reset or "never mind" function. For instance, if a clerk 16 reaches into a wrong collection-unit 14 or reaches into one and discovers that an object 18 there is not one that they are supposed to pick-up, the clerk 16 can use an appropriate control button 38 to erase or to de-emphasize the event of sensing the tag 24 or tags 24 for that collection-unit 14 (with most errors by the DDS 10 tending to be false positives, anyway). Still other uses for the control buttons 38 are with respect to the I/O port 40 described next.

The I/O port 40 can be either a wired or a wireless type. If the I/O port 40 is a wired type, the DRD 26 in most embodiments of the DDS 10 will not be used while the I/O port 40 is connected to an external system. This is not a necessity, however, and embodiments for some particular applications can be exceptions even to this. Generally, however, wearing or handling a wired, or tethered DRD 26 can be unduly awkward. To avoid this, embodiments of the DRD 26 can store information related to a quantity of the tags 24 that have been sensed in their memory 30, with this information easily downloaded at a later time by temporarily connecting the I/O port 40 of the DRD 26 to an external system. In this case, a control button 38 can be used to initiate the download. Simpler still, the processor 28 can be programmed to detect when the DRD 26 is connected to a suitable external system and to then automatically "push" the information it has accumulated to the external system. If the power source 32 of the DRD 26 is rechargeable, it may be desirable to implement the DRD 26 to work with a "cradle" station for recharging, much like many cellular telephones and personal digital assistants employ such today. Such a cradle station can then have connections to supply charging power to the power source 32 as well as connections for the I/O port 40.

When the I/O port 40 is a wireless type, considerable variation in the DRD 26 is possible. One set of such options relates to how the DRD 26 is used. For instance, with a suitable external system able to receive communications from the DRD 26 at an appropriate range, the DRD 26 can immediately "broadcast" information related to each tag 24 as it is sensed. Conceptually, the DRD 26 then is used like a "repeater," as those familiar with the radio communication arts commonly use that term. Alternately, the DRD 26 can accumulate information about a number of sensed tags 24 and broadcast all of that information as a batch. Or the DRD 26 can even do both of these (thus employing redundancy to ensure accuracy and, optionally, using event time-stamping to help correlate events).

The DRD 26 can accordingly be configured to accumulate and download information related to sensed tags 24 whenever it comes close to a suitable external system and to receive a download command from such a system via its I/O port 40 (that is, the I/O port 40 can be bi-directional, if desired). The DRD 26 can thus download the relevant contents of its memory 30 and, typically in response to an acknowledgement from the external system, erase (or, more typically, flag as available for reuse) those portions of its memory 30 to make them for new information to be read from future tags 24. Alternately, the DRD 26 can be configured to download any new information since a previous download, and to use a portion of its memory 30 in a first-in-first-out (FIFO) or circular buffer-like manner to overwrite information about older events with information about newer ones. Again, redundancy can be deliberately used to ensure accuracy and optional event-numbering or time-stamping can be used to correlate duplicate records to individual events. When the real time clock 29 is provided, it can be synchronized with an external clock, via the I/O port 40, thus ensuring that such time-stamping is consistent.

For wired-type instances of the I/O port 40, RS 232, RS 485, 20-ma current loop, universal serial bus (USB), IEEE 394, and various proprietary protocols are suitable candidates. Note, "wired" here is used loosely, and the I/O port 40 can use a fiber optic connection.

For wireless-type instances of the I/O port 40, infrared (IR) personal computer and personal digital assistant ports, BLUETOOTH, IEEE 802.x, and various proprietary protocols are all suitable candidates.

In particular, with full featured wireless network protocols like IEEE 802.x available in increasingly smaller form factors, the DRD 26 can be implemented with an Internet protocol (IP) address and can easily operate within a conventional office-type wireless network.

If such a network, e.g., a conventional local area network (LAN), encompasses a company's mailroom (i.e., a collection-station 12 from the standpoint of the inventive DDS 10), the DRD 26 can be used to advise clients 20 via the LAN, essentially immediately, that there has been an event related to their collection-units 14. Of course, as is widely the case today, the LAN in this scenario can be connected to a wide area network (WAN), such as the Internet, and a client 20 can then be a considerable distance away from their collection-unit 14 and still be aware of any events related to it (that is, presumably, events involving objects 18 being placed into or removed from their collection-unit 14).

If the wireless LAN of our hypothetical company does not well encompass its mailroom, the DRD 26 can still facilitate matters considerably. When a clerk 16 leaves the mailroom and does enter the wireless LAN, say, as they go to lunch or as they pass through a security checkpoint, the DRD 26 can then download its information via the LAN to an external system.

One particularly useful variation of the DRD 26 using a wireless type I/O port 40 is to permit multiple DRDs 26 to intercommunicate in "smart dust" mode. For example, a first DRD 26 worn by a first clerk 16 can detect a first set of tags 24, say ones with identification characteristics like #436, #437, and #511. Similarly, a second DRD 26 used by a second clerk 16 can detect a second set of tags 24, say #436, #438, and #513. When the first and the second DRDs 26 come within range of one another they can then automatically pool the information they have collected, so that each has copies of all of that information (i.e., the information related to all of #436, #437, #438, #511 and #513). Alternately, the first and the second DRDs 26 can be programmed so that the first DRD 26 flushes its collected information to the second DRD 26, leaving the first DRD 26 with no currently stored information and leaving the second DRD 26 with all of the jointly accumulated information. In essence, this latter scenario has the second DRD 26 acting as an "external system" with respect to the first DRD 26.

Figure 5A:
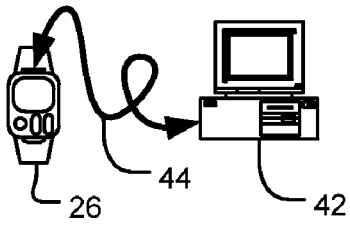
FIG. 5*a–d* are schematic diagrams depicting some exemplary ways that a DRD in accord with the present invention can communicate with an external system via a link.

FIG. 5*a–d* are schematic diagrams depicting some exemplary ways that the DRD 26 can communicate with an external system 42 via a link 44, as well as summarizing much of what has just been discussed. In FIG. 5*a* a very basic case is shown where the external system 42 is a simple one, such as a personal computer (PC), and the link 44 physically connects to the 110 port 40 of the DRD 26. While this case is simple, however, it should be appreciated that embodiments of the DDS 10 like this are still quite adequate for many applications. For example, the information accumulated from the tags 24 into the external system 42 may never be needed beyond the external system 42, or it can be stored onto removable media, such as floppy disk, CD-R, or USB "drive" and loaded from there onto one or more other systems as needed.

Figure 5B:
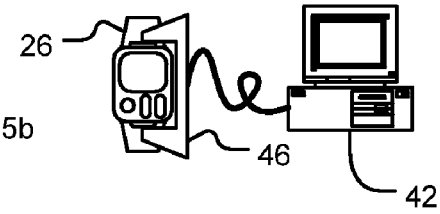

FIG. 5*b* shows only a slightly more complex case. Here the DRD 26 connects to a station 46 for recharging and exchanging information with an instance of the external system 42 connected to the station 46. The link 44 is still present here, just reduced to trivial size (and therefore not shown).

Figure 5C:
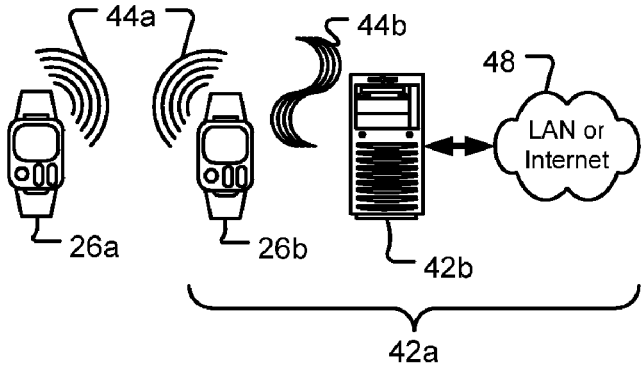

FIG. 5*c* shows yet a more complex case. Here a first DRD 26*a* communicates via a wireless first link 44*a* with a second DRD 26*b* that, in turn, communicates via a wireless second link 44*b* with an instance of the external system 42 that is connected to a network 48 (e.g., a local area network (LAN) or the Internet). There are therefore effectively two external systems 42*a*, 42*b* here. The first DRD 26*a* can communicate via the first link 44*a* with the second DRD 26*b*, thus using the second DRD 26*b* as the first external system 42*a* (and depending on how one views things, also using the second link 44*b*, the second external system 42*b*, the network 48, etc. as one big external system). The second DRD 26*b* can then communicate via the second link 44*b* with the second external system 42*b*.

Figure 5D:
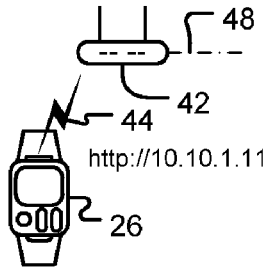

FIG. 5*d* shows a case using emerging technology. Here a DRD 26 is itself a formal network device, having its own IP address and a link 44 to a Wi-Fi router (an external system 42 of first instance, connected to additional systems via a network 48).

Figure 6:
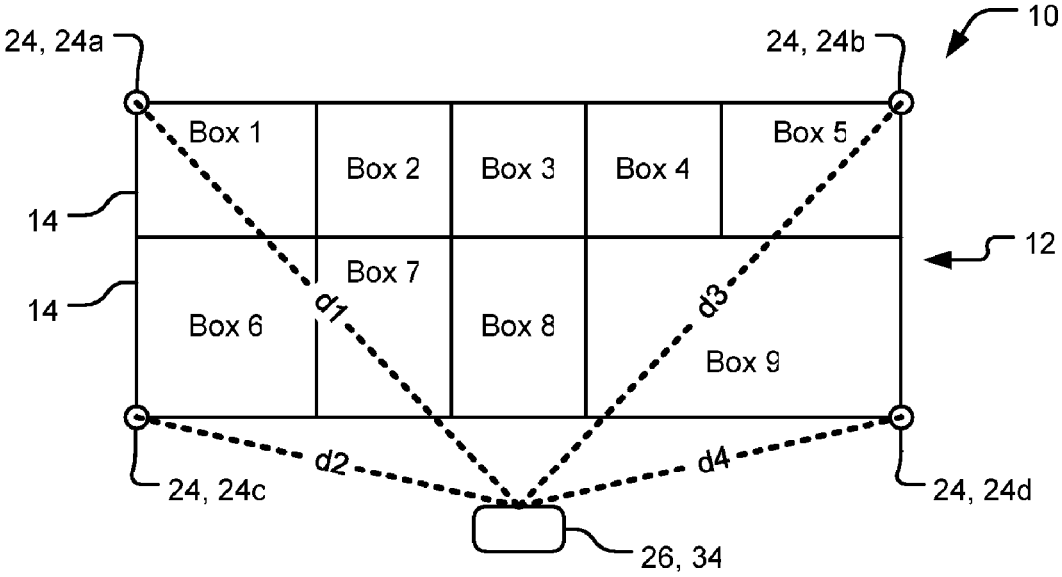
FIG. 6 is a schematic diagram showing a front face view of an embodiment of a DDS in accord with the present invention that uses a DRD with a particularly sophisticated, position-detecting type sensor.

FIG. 6 is a schematic diagram showing a front face view of an embodiment of the DDS 10 using a DRD 26 with a particularly sophisticated sensor 34. Here the sensor 34 includes a position-determining capability that permits the DRD 26 to calculate where it is relative to a set of tags 24 that are placed about the collection-station 12. As can be seen, the number of tags 24 used is less than the number of collection-units 14 of interest. This arrangement is particularly useful if the number of collection-units 14 in a collection-station 12 is changeable or if the size of the collection-units 14 is easily changed.

As few as two tags 24 can be used, but does not always well determine when a collection-unit 14 is actually accessed. Various refinements can be used to handle this. The DRD 26 can be configured to have the clerk 16 trigger a determination, say, by pushing a control button 38 each time they access a collection-unit 14. This will be adequate in some applications, but in others may be unduly awkward and prone to the clerk 16 forgetting to use the control button 38. The DRD 26 can then trigger on a motion specific to accessing a collection-unit 14 instead, such as flexing of the wrist of the clerk 16 wearing the DRD 26. Alternately, a second assumption can be used that information logging is needed when the DRD 26 is stationary for some period of time. When to collect information in these latter two approaches may be additionally "qualified" by whether the DRD 26 is positioned consistent with a collection-unit 14 being accessed. Still alternately, the sensor 34 can optically detect the change in lighting level as it physically enters collection-unit 14, and trigger information logging then. Yet alternately, the sensor 34 can detect when it is in a magnetic field (e.g., from a magnet in the tag 24 or from one otherwise provided at a collection-unit 14).

For still some applications, however, even the above approaches may be too awkward and error-prone. To address such problems at least three tags 24 can be used, with FIG. 6 showing a case where four are used. With this many tags 24 the DRD 26 in the DDS 10 can determine where it is relative to both the face and depth within the collection-station 12. That is, the DRD 26 can detect its three-dimensional location relative to the tags 24 and trigger an information collection event only when its position is consistent with a collection-unit 14 having been reached into.

With reference again to FIG. 2 and now turning away from the DDS 10 that has so far been discussed, the underlying concept of the present invention and the breath of its scope can be appreciated by considering this figure in the abstract without the others. Although seemingly very simple, FIG. 2 actually depicts how a tag 24 can be placed anywhere in a volume of space and the DRD 26 can record the fact of having come within sensing range of it. Put another way, the conventional thinking when dealing with RFID devices is that the device moves and the sensor is maintained stationary. What the present inventor has appreciated is that there is considerable advantage in many existing applications, as well as many heretofore unknown or impractical applications, where an RFID device (i.e., our tag 24 here) can be maintained stationary and the sensing device (i.e., our DRD 26 here) brought to it. We now cover some aspects of this that are not well served by the example of the DDS 10.

In the DDS 10 examples, we have used the delivery and pick-up of objects 18 in collection-units 14 of collection-stations 12. There is no reason, however, that the present invention be limited to relatively small, semi-closed compartments like mailboxes, drop-boxes, cubby-holes, etc.; or that the objects 18 be small, inanimate ones like parcels; or that the bearer of a DRD 26 be a human clerk 16.

For example, a DRD 26 can be worn by a watch-person as they make their rounds of a building, an entire campus of buildings, or even many widely separated properties. One or more tags 24 previously placed on or inside items that our watch-person comes into proximity with can then easily be sensed and logged. For instance, a tag 24 can quite simply be incorporated into the warning stickers that an alarm company typically places on the external surface of doors to a building, and our hypothetical watch-person wearing the DRD 26 can thus, even unknowingly, collect identifying information from each tag 24 as they enter and leave such a building. Or the tags 24 can be embedded into the door handles, door frames, etc. of every entrance and exit to a building, and the DRD 26 can then log the movements of its bearer into rooms where they are expected to go, and possibly ones where they are not expected to go.

As another example, our correctional system in the United States already makes extensive use of complex, expensive systems to monitor criminals under house-arrest for minor offenses. Typically, a person monitored in this manner wears a hard to remove anklet or bracelet transmitter that communicates over a limited range with a "base-station" connected to a live, randomly polled telephone line at their home.

The use of these house arrest monitoring systems, however, has lead to social inequity because some socio-economic classes of criminals are most frequently sentenced to house-arrest. Existing systems are expensive. Today such systems are widely provided and maintained by private companies under contract with legal authorities, and many courts assign people sentenced to house arrest to pay the costs associated with their sentence. As a result, sentences to house-arrest are more frequently applied to our economically middle and upper classes or are more commonly used by court systems in our more affluent areas.

The use of most existing house arrest monitoring systems also require a fixed telephone line, and this makes them inappropriate for some classes of criminals. For instance, we now have a growing class of people who eschew fixed telephone lines and instead have only cellular telephones.

The present invention can economically replace conventional house-arrest monitoring systems, and it can do this economically, more fairly, and in manners that avoid a number of technology-based limitations in the prior art house-arrest monitoring systems.

As already noted in passing, however, a tag 24 can be incorporated into something as cheap, disposable, and fragile as a sticker. Furthermore, a tag 24 can be made as or incorporated into something very small and unnoticeable. Accordingly, tags 24 can intentionally be made (in sticker or other external form factor) so that they are easily rendered inoperative by tampering and they can be placed both where a bearer is allowed and is not allowed to go.

A DRD 26 can easily be made hard to remove from its bearer, both physically hard to remove and to easily show if it has been removed and reattached. Constructing the DRD 26 to be robust enough to be worn for a month or more is also relatively easy. [Typical prior art house-arrest monitoring systems today require a transmitter wearer to go in monthly or bimonthly for battery replacement and physical inspection.]

So, turning now to some examples, a tag 24 can be placed on a bedpost or nightstand drawer for the DRD 26 to detect and log the presence of its bearer during typical sleep hours. The location for the tag here need not even be in a conventional, fixed house. For instance, it can just as easily be in a mobile home, since the proximity of the tag 24 and the DRD 26 is what is important and proximity to a fixed telephone line can be irrelevant.

Another tag 24 can be placed in an automobile of a DRD 26 bearer, to be detected and logged as the bearer goes to and from work, as they presumably are expected to do, or to be detected and logged if they make even the briefest of unauthorized late-night excursions, say to purchase alcohol or drugs.

There is also no particular requirement in this scenario that the bearer of a DRD 26 be shown or told where all or any of the tags 24 are placed. One or more tags 24 can thus be placed about the property of a party that the bearer of the DRD 26 is not supposed to have contact with, say, a celebrity that the bearer of has previously stalked or an abused spouse with a restraining order.

As for downloading data from the DRD 26, variations of the already discussed approaches make this easy as well. A probation department office could provide stations 46 to connect the DRD 26 for data downloading, re-tasking, etc. If such stations are wireless, the wearer-bearer of a DRD 26 would not have to have an appointment, wait in line, etc. If a DRD 26 has its own IP address, its wearer-bearer could simply go to any Wi-Fi "hot spot" and push a control button 38 on the DRD 26 to "report in."

Taking this penal system aspect conceptually further, the use of tags 24 and DRDs 26 in the manner of the present invention has wider utility in our criminal justice system. Lesser-security prison systems can use tags 24 in cells, passage ways, important locations, etc. and can use DRDs 26 that are tamper resistant or self reporting with respect to tampering attempts. This permits considerably reducing prison staffing needs by making the prisoners accountable for much of their whereabouts and movements in a largely self-reporting manner. Additionally, trustee prisoners can now be used to a greater extent, with the information in their DRDs 26 about the tags 24 that they have come into proximity with keeping them accountable and ensuring that they are trust-worthy.

Turning now to other general applications of the present invention, there is no particular limitation that the bearer of a DRD 26 be human. For instance, the bearer in our watch-person example above could just as easily be a guard dog outfitted with a DRD 26.

Taking this non-human aspect conceptually further, the movements of a robotic "worker" in a factory assembly environment can be recorded using tags 24 and a DRD 26. Granted, few robots are presently capable of autonomous movement to the extent that logging their actual movements is desirable, but there is already a clear trend toward such autonomy. And for that matter, the use of tags 24 and a DRD 26 is an excellent temporary tool when diagnosing and training robotic systems to achieve such capabilities.

Returning briefly again to applications of the present invention that deal with human proclivities, the inventor recently observed an application that many urban and suburban dwellers will appreciate. A few months ago the tenants in an residence called their city office complaining that the garbage truck was not always showing up twice weekly to remove the garbage in their dumpster. The garbage truck crew-person would not admit that he had ever missed any scheduled pickups, and this simple affair therefore pitted the building tenants, the garbage truck crew-person, and the sanitation company's supervisor in a situation where the facts were in determinative. In the present scheme of things, the sanitation company's conventional option would be to install a GPS device on each of its trucks to track their movement, with all of the attendant expense such would necessarily entail. However, if each garbage container or dumpster had a tag 24 and if either the garbage truck crew-person shifting the dumpster into place for emptying or the loading arm of the garbage truck itself had a DRD 26, accountability would have been easy.

Figure 7:
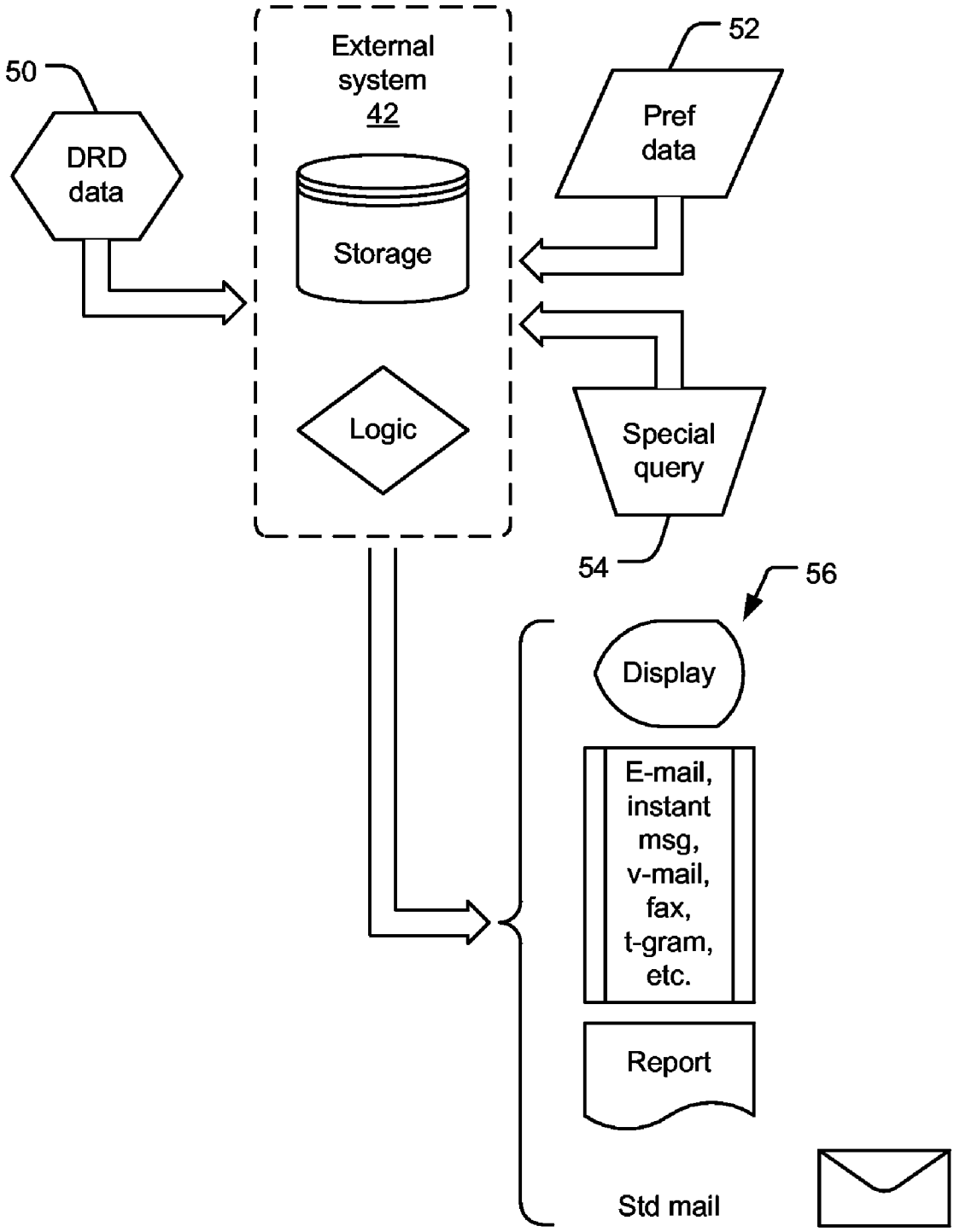
FIG. 7 is a schematic diagram showing some possible options for using the DDS with the external system.

FIG. 7 is a schematic diagram showing some possible options for using the DDS 10 with the external system 42. At a basic level the external system 42 includes storage and logic. It receives and stores event data 50 from the DRDs 26 and preference data 52 in any, typically conventional manner. Additionally, it can receive special queries 54. Based on the preference data 52 or a special query 54 the external system 42 will process the event data 50 and provide an output 56.

Consider some examples. The DDS 10 and the external system 42 can be used to notify a client 20. The client 20 can already be set up for this in the preference data 52 or this can be handled with a special query 54. For a special request, the external system 42 can simply provide the output 56 on a local display. Alternately, an organization can set up its installation so that its clients 20 receive an e-mail, voice-mail, instant message (IM), text message, facsimile, telegram, etc., whenever a delivery arrives. The same organization may also have its clients 20 or their supervisors set up to receive monthly reports summarizing all pickups, perhaps with a few special collection-units 14 set up so that confirmation notices are mailed for all pickups and deliveries.

Of course, the uses for the information from the DDS 10 and the "value added" operations that can be performed based on it can include much more. As just one example, a mailbox owner can find out online that new objects 18 have been delivered. He can then request that photos or faxes of these objects 18 be sent to him. A clerk 16 in his company's mail room or at the postbox company he is using can then make a special run for such clients 20 each day. The clerk can push around a cart with a suitable digital imaging device to each collection-unit 14, then remove the contents, photograph them, and put the contents back. In one variation of this the clerk 16 can employ a panel on the cart to enter the number or other identifying information for the collection-unit 14. In another variation, this clerk 16 can simply use a DRD 26 that immediately transfers data from the last tag 24 encountered to the cart (i.e., the cart here is just another form of external system 42). After the run is finished, the clerk 16, or the cart automatically, can send the digital photos to the respective clients 20 as e-mail attachments.

While various embodiments have been described above, it should be understood that they have been presented by way of example only, and not limitation. Thus, the breadth and scope of the invention should not be limited by any of the exemplary embodiments here, but should instead be defined only in accordance with the following claims and their equivalents.

INDUSTRIAL APPLICABILITY

The delivery and pickup determination system (DDS 10) in accord with the invention here is well suited for application in residential, corporate, and governmental environments where clerks handle objects that are delivered or left for pickup.

The DDS 10 can be installed and employed quite economically to begin with in virtually all existing or new collection-stations 12, and can be scaled up to serve additional collection-units 14 or collection-stations 12 very quickly and economically as well. The primary new components of the DDS 10 in a given installation will be the tags 24, one or more detection and recording devices (DRDs 26), and an external system 42 with appropriate software to work with the DRD 26 and perform any desired post-data acquisition manipulations. The external system 42 can otherwise be essentially conventional, and in many cases will already be available. The quantity of tags 24 used is in relation to the number of collection-units 14 being monitored, with as few as one DRD 26 and one external system 42 able to serve across a large number of collection-units 14 and even multiple collection-stations 12, if desired. The tags 24 themselves can be quite inexpensive, with suitable components currently available for less than $0.20 each in 1,000 unit quantities. This is a marked improvement over prior art systems, where the number of clients (collection units and stations) being served tends to make delivery and pickup determinations increasingly expensive.

The DDS 10 can also enjoy a very low error rate, wherein those errors encountered will generally be false positives or "errors on the side of caution." By appropriate selection of the types of the tags 24 and DRD 26 to work with a particular collection-station 12, the DDS 10 can be "tuned" considerably to reduce errors to begin with. Since the DDS 10 is inherently highly automated, most "human" sources of error are eliminated. Nonetheless, since errors inevitably will occur even in the DDS 10, the DRD 26 can be embodied as has been described herein to facilitate catching these and correcting them before they have any consequences.

For the above, and other, reasons, it is expected that the DDS 10 will have widespread industrial applicability and it is therefore expected that the commercial utility of the present invention will be extensive and long lasting.

What is claimed is:

1. A system for determining whether a clerk has delivered or picked up an object at a particular collection-unit in a collection-station including a plurality of permanently stationary collection-units, wherein the particular collection-unit is assigned to an owner of the object, comprising:

a radio-frequency identification (RFID) tag placed in fixed conjunction with the particular collection-unit; and a detection and recording device (DRD) worn about the hand of the clerk to sense and collect information about said RFID tag when brought into proximity with it as the object is handled at the particular collection-unit.

2. The system of claim 1, wherein said RFID tag includes a passive type RFID device.

3. The system of claim 1, wherein said RFID tag is placed in fixed conjunction with the particular collection-unit by semi-permanent affixation.

4. The system of claim 3, wherein said RFID tag is embodied in a sticker.

5. The system of claim 1, wherein said RFID tag is placed in fixed conjunction with the particular collection-unit by temporarily locating said RFID tag stationary in the particular collection-unit for said DRD to sense.

6. The system of claim 1, wherein said DRD collects said information about said RFID tag automatically as said DRD is brought close enough to sense said RFID tag.

7. The system of claim 1, wherein said DRD is triggered to collect said information about said RFID tag by a stimulus other than just being close enough to sense said RFID tag.

8. The system of claim 7, wherein said DRD is triggered by at least one member of the set consisting of a physical action by the clerk, a change in a magnetic field, a change in ambient light, and a position calculation based on a radio signal.

9. The system of claim 1, wherein said DRD includes a clock to time-stamp said information.

10. The system of claim 1, wherein said DRD immediately communicates said information to an external system.

11. The system of claim 1, wherein said DRD stores said information about said RFID tag for later communication to an external system.

12. A method for determining whether a clerk has delivered or picked up an object at a particular collection-unit in a collection station including a plurality of permanently stationary collection-units, wherein the particular collection-unit is assigned to an owner of the object, comprising:

having a radio-frequency identification (RFID) tag in fixed conjunction with the particular collection-unit; and sensing said RFID tag with a device worn about the hand of the clerk as the object is brought into or taken from proximity with said RFID tag; and collecting identification information about said RFID tag while in proximity with said RFID tag.

13. The method of claim 12, wherein said RFID tag includes a passive type RFID device.

14. The method of claim 12, wherein said step of sensing occurs as the clerk is handling the object.

15. The method of claim 12, wherein said step of collecting occurs automatically based on occurrence of said step of sensing.

16. The method of claim 12, wherein said step of collecting is triggered by a stimulus additional to occurrence of said step of sensing.

17. The method of claim 16, wherein collecting is triggered by a stimulus including at least one member of the set consisting of detecting a physical action by the clerk, detecting a change in a magnetic field, detecting a change in ambient light, and calculating a position based on a radio signal.

18. The method of claim 12, further comprising time-stamping said identification information.

19. The method of claim 12, further comprising communicating said identification information to an external system.

20. The method of claim 19, further comprising storing said identification information before communicating said identification information to said external system.

21. The method of claim 12, wherein the plurality of collection-units in the collection-station includes an equal or lesser plurality wherein each collection-unit therein has at least one said RFID tag in conjunction therewith, and the method further comprising:

discriminating among all said RFID tags concurrently sensed to select a single said RFID tag that is in fixed conjunction with the particular collection-unit; and performing said step of collecting for said single said RFID tag.

22. The method of claim 21, wherein said step of performing is performed only for said single said RFID tag.

23. A system for determining whether a clerk has delivered or picked up an object at a particular collection-unit in a collection-station including a plurality of permanently stationary collection-units, wherein the particular collection-unit is assigned to an owner of the object, comprising:

radio-frequency identification (RFID) means embodied in a tag form factor wherein said RFID means is in fixed conjunction with the particular collection-unit; and means for sensing said RFID means as the object is brought into or taken from proximity with said RFID means, wherein said means for sensing is worn about the hand of the clerk; and means for collecting identification information about said RFID means while in proximity with said RFID means.

24. The system of claim 23, further comprising means for triggering said means for sensing.

25. The system of claim 23, further comprising means for time-stamping said identification information.

26. The system of claim 23, further comprising means for communicating said identification information to an external system.

27. The system of claim 23, wherein the plurality of collection-units in the collection-station includes an equal or lesser plurality wherein each collection-unit therein has at least one said RFID means in conjunction therewith, and the system further comprising:

means for selecting a single said RFID means that is in fixed conjunction with the particular collection-unit from among all said RFID means concurrently sensed; and means for controlling said means for collecting to collect said identification information about said single said RFID means.

* * * * *